United States Patent [19]

Koffler et al.

[11] 4,335,896

[45] Jun. 22, 1982

[54] LUGGAGE CASE HAVING A DETACHABLE ROLLER ASSEMBLY

[75] Inventors: Sol Koffler, Providence; William M. Berry, East Providence, both of R.I.

[73] Assignee: American Tourister, Inc., Warren, R.I.

[21] Appl. No.: 138,186

[22] Filed: Apr. 7, 1980

[51] Int. Cl.[3] ..... B62B 1/04

[52] U.S. Cl. ..... 280/47.17; 16/30; 190/18 A

[58] Field of Search ..... 280/47.17, 47.19, 47.2, 280/47.26, 35, 37, 79.1, 79.2, 79.3; 190/18 A, 18 R; 16/29, 30

[56] References Cited

U.S. PATENT DOCUMENTS

| | | | |
|---|---|---|---|
| 1,546,169 | 7/1925 | Dooley | 16/30 |
| 3,229,991 | 1/1966 | Tessler et al. | 280/47.26 |
| 3,285,620 | 11/1966 | Mitty et al. | 280/47.26 |
| 4,026,569 | 5/1977 | Staal | 280/37 X |
| 4,026,570 | 5/1977 | Feinberg | 280/47.17 |
| 4,213,225 | 7/1980 | Timmer | 16/29 X |
| 4,254,850 | 3/1981 | Knowler | 190/18 A |

*Primary Examiner*—Richard A. Bertsch

*Attorney, Agent, or Firm*—Salter & Michaelson

[57] ABSTRACT

A luggage case is disclosed that includes a roller assembly that is detachably secured to a section of the luggage case, wherein a roller engages a surface to enable the luggage case to be conveniently rolled thereover. The roller assembly is mounted such that it cannot be accidentally dislodged, even when the roller abruptly contacts an obstruction such as a rut, rock or curb.

15 Claims, 16 Drawing Figures

LUGGAGE CASE HAVING A DETACHABLE ROLLER ASSEMBLY

BACKGROUND OF THE INVENTION

Recently it has been the practice in construction of hand luggage to mount a caster or roller thereon to assist the user in the transporting thereof. Heretofore hand luggage cases which incorporated a caster thereon had been constructed such that the caster assembly was formed as a permanent part of the luggage case. Usually in such construction the caster extended outwardly of the luggage case and oftentimes resulted in inconveniences in the carrying or in the storing thereof. Thus it has been found as a practical matter that casters are not always desirable in many instances of use of the luggage.

Prior to the instant invention, some efforts have been made to provide detachable caster assemblies for hand luggage cases, and one such construction is illustrated in the patent to FEINBERG, U.S. Pat. No. 4,026,570. The caster assembly as illustrated in U.S. Pat. No. 4,026,570, does provide for detachably connecting a mounting plate assembly to a corner of a luggage case, but the mounting plate assembly as illustrated in the aforesaid patent is secured to the exterior wall of the luggage case, and thus permanently protrudes outwardly therefrom. Since the mounting plate assembly as illustrated in U.S. Pat. No. 4,026,570 does extend externally of the luggage wall, it is clearly visible and tends to detract from the ornamental appearance of the luggage case. Further, the mounting plate assembly as illustrated in the aforesaid patent includes apertures for receiving mounting tabs of the wheel assembly, and when the wheel assembly is removed from the mounted position thereof, the apertures therein are exposed to enable debris to filter into the apertures for collection between the case wall and the mounting plate assembly. The prior known construction also includes additional openings in the mounting plate assembly for receiving a spring element, and the additional openings as formed in the mounting plate assembly also enable dirt, debris or water to infiltrate therethrough for collection interiorly of the mounting plate assembly. Since the mounting plate assembly as utilized in the prior known construction illustrated in U.S. Pat. No. 4,026,570, is mounted in place by externally visible rivets, the entire assembly including the rivets are formed as a permanent part of the luggage exterior and hence detracts from the ornamental appearance thereof. The construction as illustrated in the aforesaid patent is also objectionable since the mounting plate is subject to be dislodged from its mounted position when the roller or caster thereof accidentally strikes an abutment or rut.

It is the purpose of the present invention to overcome the objectionable features of the detachable caster shown in U.S. Pat. No. 4,026,570 and to further provide a unique detachable roller assembly that can be conveniently mounted in place and disassembled therefrom as required.

The above-referred to patent to FEINBERG, U.S. Pat. No. 4,026,570 represents the best prior art known to applicants to which the subject invention pertains.

SUMMARY OF THE INVENTION

The present invention is directed to a luggage case that includes a pair of hinged shell sections, at least one of the shell sections including means for receiving a roller assembly thereon in detachable relation. Spaced openings are formed in the one section adjacent to a corner thereof, and a roller assembly is secured in the opening and projects outwardly of the exterior surface of the case section. The roller assembly includes a pair of pivotal roller brackets through which the roller axle extends, a roller being mounted for rotation on the axle. A mounting tab is secured to each of the roller brackets at an outer end thereof and resilient means are provided for normally urging the roller brackets on which said mounting tabs are mounted away from each other. The roller brackets are movable inwardly against the action of the resilient means for locating the tabs in the openings in the case section for releasably mounting the roller assembly on the luggage case section. The roller thus projects outwardly of the luggage case section for engagement with a surface to provide for the convenient travel of the luggage case thereon. The openings in the case section are also formed of different size which provides for easy insertion of the tabs therein but prevents accidental dislodging of the tabs therefrom should the roller abruptly contact an obstruction or rut.

Accordingly it is an object of the present invention to provide a luggage case to which a roller assembly is conveniently attached or detached as required.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
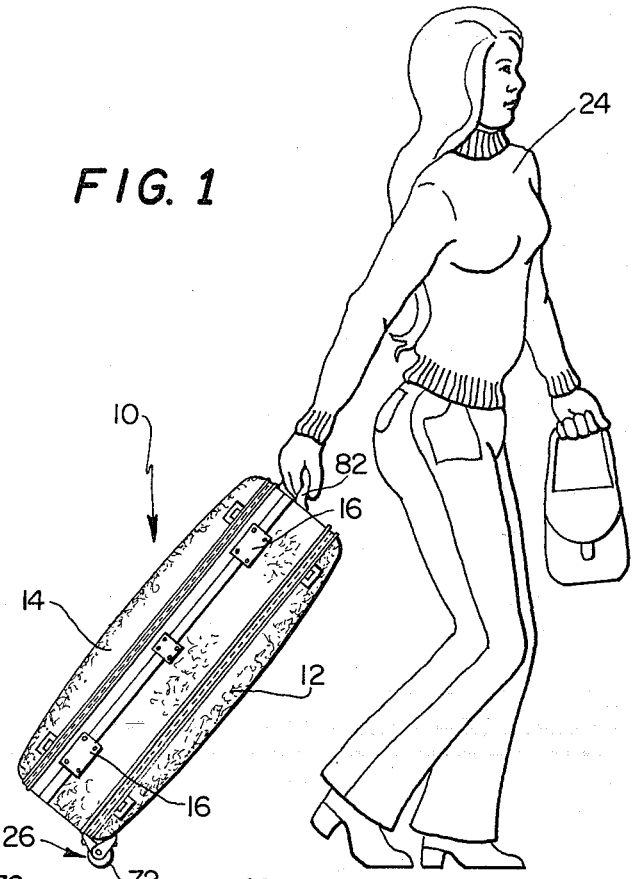
FIG. 1 is a rear elevational view of one form of the luggage case embodied in the present invention and illustrating the case in an up-ended, inclined position when moved by a user over a surface.
Figure 2:
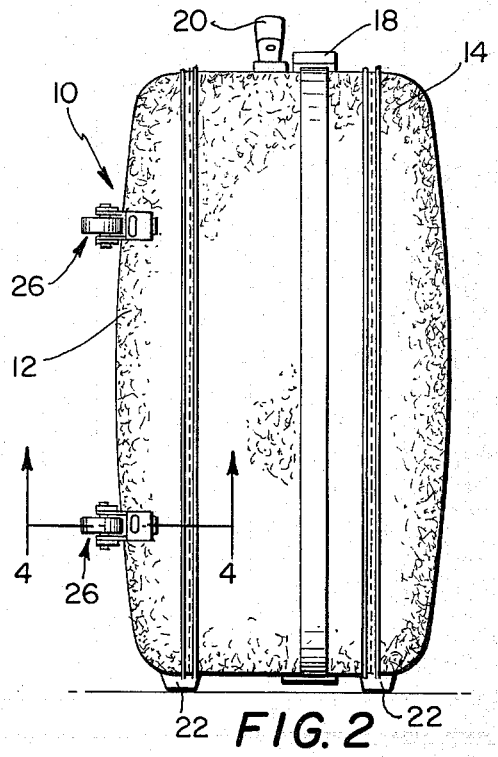
FIG. 2 is a side elevational view of the luggage case shown in FIG. 1.
Figure 3:
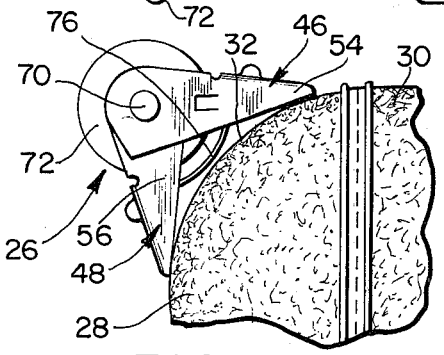
FIG. 3 is an enlarged elevational view of a portion of the luggage case showing the roller assembly as mounted in position thereon.

Referring now to the drawings and particularly to FIGS. 1 and 2, one form of the luggage case as embodied in the present invention is illustrated and is generally indicated at 10. The luggage case 10 as shown includes a bottom shell or section 12 and a top shell or section 14, the sections 12 and 14 being hingedly connected together by hinge assemblies 16 in the conventional manner. The sections 12 and 14 are formed of any suitable material but are preferably formed of a metal or plastic material. The sections which have a shell-like configuration also include a lock 18, handle or hand grip 20 and foot pads 22, all of which are conventional in construction and therefore do not form any part of the present invention.

Figure 4:
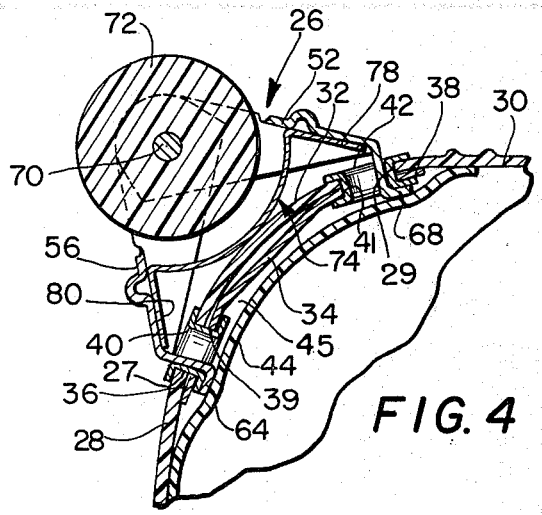
FIG. 4 is a sectional view taken along lines 4—4 in FIG. 2 and showing the roller assembly as mounted in position on the luggage case.
Figure 5:
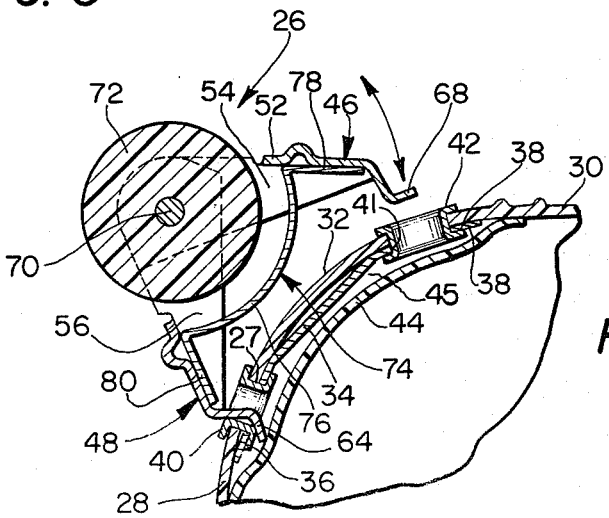
FIG. 5 is a sectional view similar to FIG. 4 and illustrating the manner in which the roller assembly is secured in position and removed therefrom.
Figure 6:
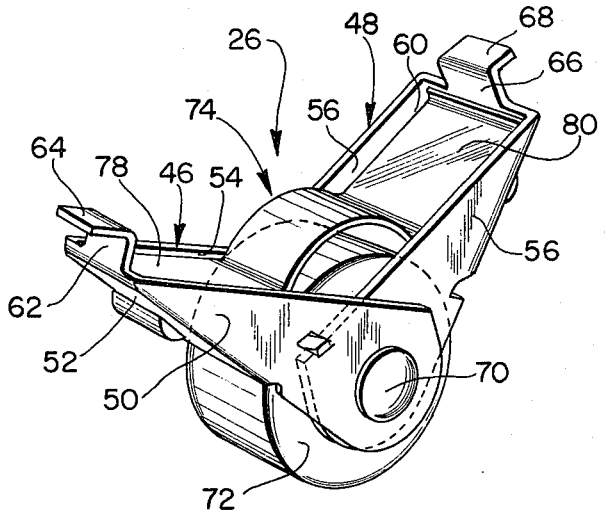
FIG. 6 is a perspective view of the roller assembly.

The purpose of the subject invention is to enable a user, who is indicated at 24 in FIG. 1, to tilt the luggage case 10 on end and roll the case over a surface without having to physically lift it. For this purpose, the bottom shell or section 12 which is formed with a bottom wall 28 and a side wall 30 has spaced openings 27 and 29 formed therein for receiving a roller assembly, which is best shown in FIGS. 4, 5 and 6 and is generally indicated at 26. The openings 27 and 29 as formed in the bottom section 12 as will be described are disposed at right angles to each other in the bottom wall 28 and side wall 30, the walls 28 and 30 converging at a corner 32 of the section 12. Located interiorly of the bottom section 12 and positioned adjacent to the corner 32 is a mounting plate 34, the construction of which includes angled end portions 36 and 38. The end portion 36 of the mounting plate is located in contact with the interior surface of the bottom wall 28, while the end portion 38 is located in contact with the interior surface of the side wall 30, both end portions 36 and 38 being formed with openings 39 and 41, respectively, that are located in alignment with the openings 27 and 29 that are formed in the bottom and side walls, respectively. Secured in the openings 27, 29 and 39, 41, respectively, are grommets 40 and 42, the flanges of the grommets overlying the outer surfaces of the bottom and side walls 28 and 30 and the end portions 36 and 38 of the mounting plate 34 to secure the mounting plate in place. As shown in FIGS. 4 and 5, the size of the opening in the grommet 40 is less than the size of the opening in the grommet 42, and as will be described, this enables the roller assembly 26 to be easily inserted in place; and since the smaller grommet is located on the forward side of the case during the travel thereof, accidental dislodgement of the roller assembly will also be prevented. As will be further described, a cover plate 44 also located interiorly of the bottom section 12 overlies the mounting plate 34 at the corner 32 for concealing the mounting plate therein. A space 45 is thus formed between the cover plate 44 and the corner 32 of the bottom section 12 and only the openings as defined by the grommets 40 and 42 are externally visible.

Figure 7:
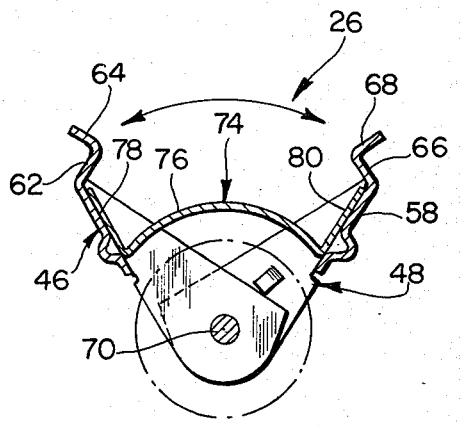
FIG. 7 is a sectional view of the brackets of the roller assembly with parts shown in elevation and illustrating the extended position of the brackets.
Figure 8:
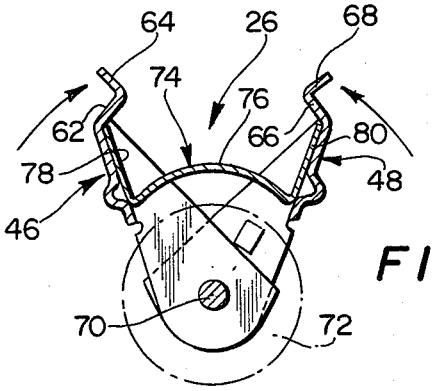
FIG. 8 is a view similar to FIG. 7 and illustrating the roller assembly brackets being moved inwardly in a manner to enable the roller assembly to be mounted in place on the luggage case.
Figure 9:
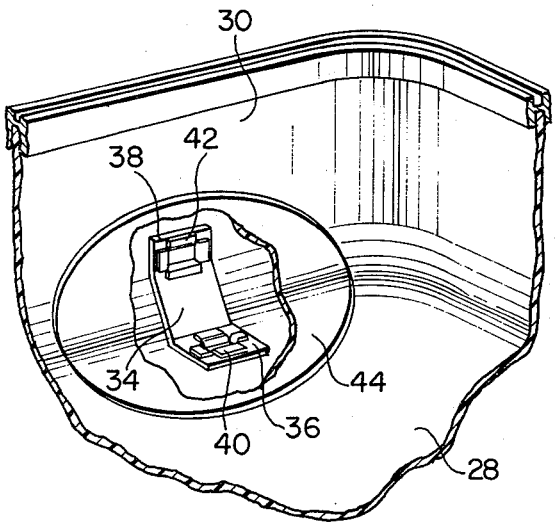
FIG. 9 is an enlarged perspective view of a portion of the interior of the luggage case illustrating the position of an interior mounting plate for the roller assembly and a cover plate that conceals the mounting plate.

Referring now to FIGS. 6, 7 and 8, the roller assembly 26 is illustrated in detail and as shown includes brackets generally indicated at 46 and 48. The bracket 46 is formed with triangularly shaped side walls 50 and a bottom wall 52 between which a trough or recess 54 is defined. The bracket 48 is similarly formed and includes triangularly shaped side walls 56 and a bottom wall 58 between which a recess 60 is defined. The bottom walls 52 and 58 of the brackets 46 and 48 are foreshortened adjacent to the base of the side walls thereof and define a central opening therebetween that receives a roller therein as will be described. Joined to the side walls 50 and bottom wall 52 of the bracket 46 is a projection 62 that has an outwardly extending tab 64 formed thereon. Similarly, a projection 66 is joined to the bottom wall 58 of the bracket 84 and has an outwardly extending tab 68 joined thereto.

Formed in the base portions of the side walls 50 and 56 of the brackets 46 and 48, respectively, are axial openings through which an axle 70 extends. A roller 72 is mounted on the axle and projects upwardly through the suitably formed openings in the bottom walls 52 and 58 of the brackets 46 and 48. Also formed as part of the roller assembly 26 is a spring generally indicated at 74, which as shown in FIGS. 7 and 8 includes a central bowed portion 76 and arms or end portions 78 and 80, the arms or end portions being joined to the bowed portion 76 in angular relation with respect thereto. As shown more clearly in FIGS. 6, 7 and 8, the arms 78 and 80 of the spring 74 are received in the recesses 54 and 60 of the brackets 46 and 48, respectively, the bowed portion 76 overlying the roller 72. It is seen that the spring 74 urges the brackets 46 and 48 away from each other so as to locate the tabs 64 and 68 in their furthermost apart position as shown in FIG. 7. As will be described, when the roller assembly 26 is to be mounted in place on the bottom section 12 of the luggage case, the brackets 46 and 48 are moved inwardly toward each other as shown in FIG. 8 and against the action of the spring 74, the roller assembly then being tilted as shown in FIG. 5 and the tab 64 guided into the smaller grommet 40. Thereafter, the tab 68 is inserted into the larger grommet 42 and the brackets are released. The spring 74 then urges the brackets to their fully extended position for locking the roller assembly in place.

As shown in FIG. 2, two of the roller assemblies 26 are provided for the luggage case, and similarly, the section 12 is formed with appropriately formed grommeted openings in spaced location on the bottom wall 28 at the corner 32 thereof. In the normal use of the luggage 10, the roller assemblies 26 are removed from the mounted position on the bottom section 12 of the luggage case and may be either stored in the luggage case or carried by the user as desired.

When the luggage case 10 is fully loaded and it is necessary to transport the case for some distance, the roller assemblies 26 are conveniently mounted in place as shown in FIGS. 4 and 5. In this connection, the user merely moves the brackets 46 and 48 of a roller assembly toward each other as shown in FIG. 8 and first locates the tab 64 within the smaller grommet 40 and then inserts the tab 68 in the larger grommet 42, after which the brackets are released. The spring 74 then urges the brackets 46 and 48 outwardly, the tabs 64 and 68 projecting below the grommets and into the space 45 as defined between the cover plate 44 and the grommets as illustrated in FIG. 4. In the mounted position of the roller assemblies, the interior cover plate 44 conceals the grommets 40, 42 and inserted mounting tabs 64, 68 and a cover cloth may also be secured interiorly of the luggage case sections in the conventional manner for concealing the interior cover plate 44. With the roller assemblies 26 mounted in place as shown in FIG. 2, the user 24 may then grasp a special carry handle indicated at 82 in FIG. 1 for elevating the luggage case to the up-ended and inclined position for transport over a surface on the rollers 72.

Should either of the rollers 72 in the transport of the case over a surface accidentally strike an abutment, hole or rut, the location of the smaller grommet in the forward or leading side of the case will act to prevent dislodgement of the roller assembly from its mounted position, the tab 64 of the roller assembly as located in the smaller grommet 40, being prevented from removal therefrom except after withdrawal of the tab 68 from the larger grommet 42.

Figure 10:
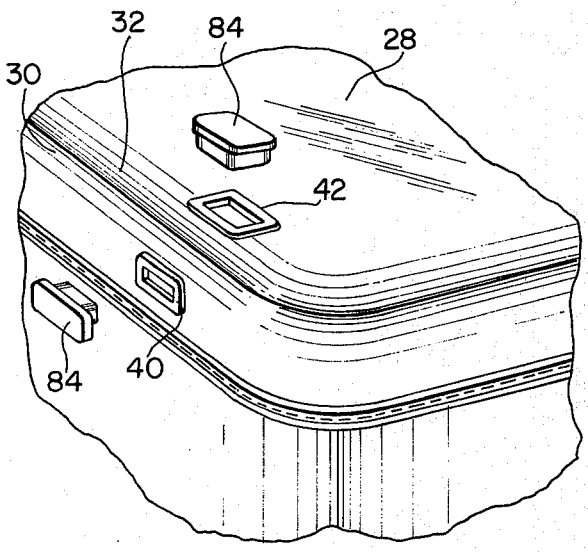
FIG. 10 is an enlarged perspective view of a corner of the luggage case and illustrating a pair of caps that are used for sealing the openings in the luggage case section when the roller assembly is removed therefrom.
Figure 11:
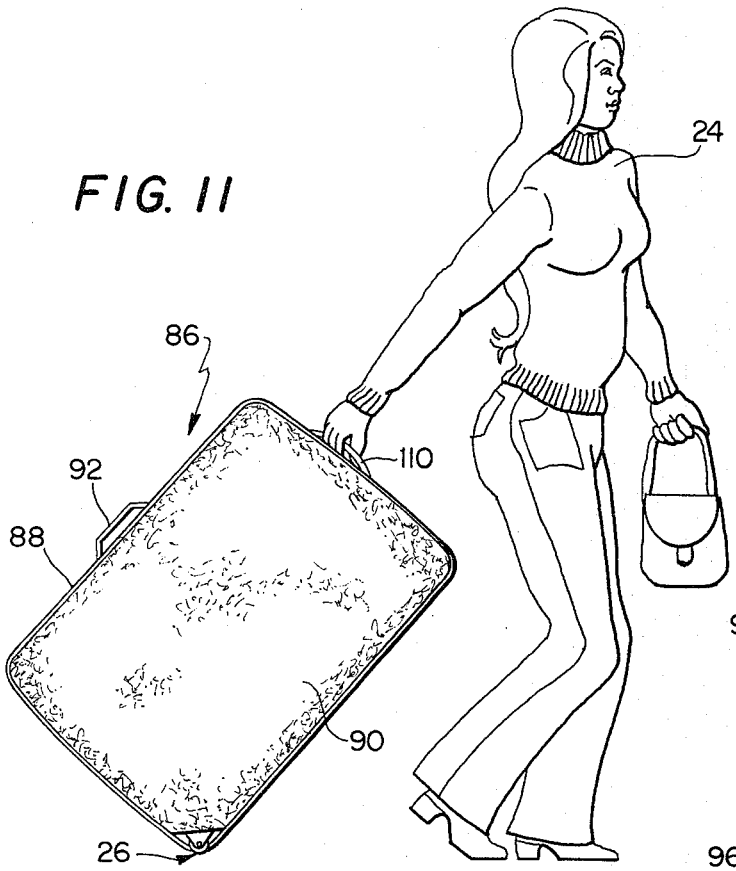
FIG. 11 is a side elevational view of a modified form of luggage case, embodied herein, wherein the case is illustrated in an up-ended, inclined position as moved over a surface by a user.

It is also seen that the roller assemblies 26 are easily removed from the mounted position thereof by squeezing the brackets 46 and 48 inwardly so that the tabs 64 and 68 clear the grommets, whereupon the roller assembly brackets are lifted outwardly of the grommeted openings for removal therefrom. Thereafter, plugs indicated at 84 in FIG. 10 may be inserted into the grommets 40 and 42 for sealing the interior space 45 as defined between the corner of the bottom section 12 and the cover plate 44.

Referring now to FIGS. 11–16, a modified form of the invention is illustrated; and as shown, a luggage case generally indicated at 86 is provided that includes a bottom section 88 and a top section 90, the top and bottom sections 88 and 90 being hingedly connected together in the conventional manner. A luggage handle 92 is secured to the bottom section 92 and feet 94 are located on the top and bottom sections to provide for resting of the luggage case on a surface as is well known in the art.

Figure 12:
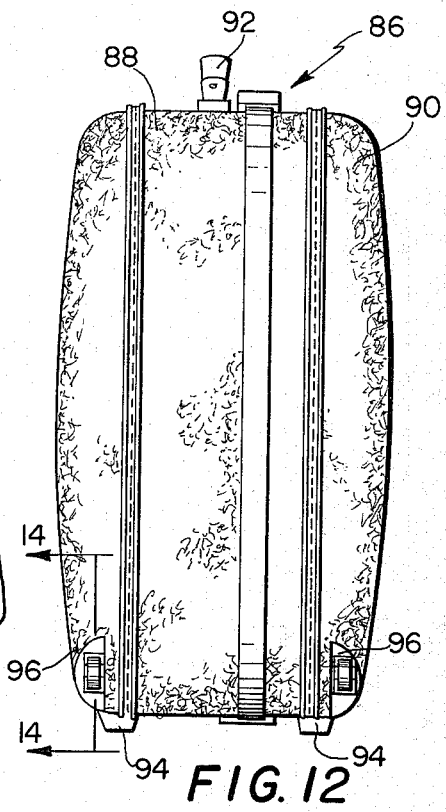
FIG. 12 is an end elevational view of the modified form of the luggage case.

As shown in FIG. 12 the bottom section 88 and the top section 90 of the luggage case 86 are each formed with a recessed or cut-out portion 96 in a corner as formed on one side thereof. For purposes of the description herein, the cut-out section 96 as formed in the bottom section 88 will be described as receiving a roller assembly 26 therein, it being understood that a similar roller assembly 26 is mounted in the cut-out portion 96 of the top section 90.

Figure 13:
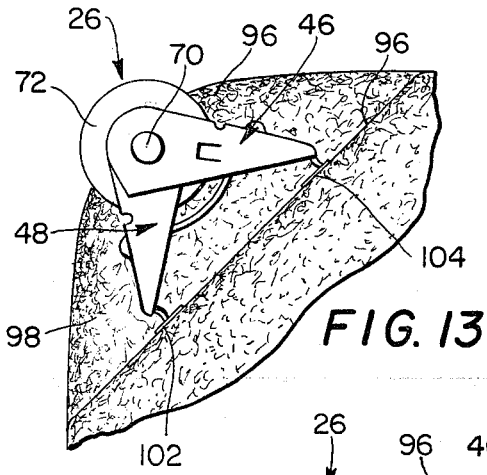
FIG. 13 is an enlarged side elevational view of a portion of the modified luggage case showing a roller assembly as mounted thereon.
Figure 14:
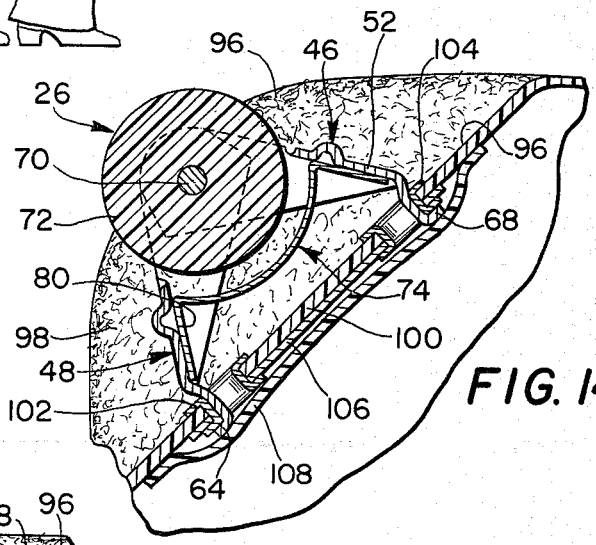
FIG. 14 is a view taken along line 14—14 in FIG. 12 and showing the roller assembly in the fully assembled position thereof.
Figure 15:
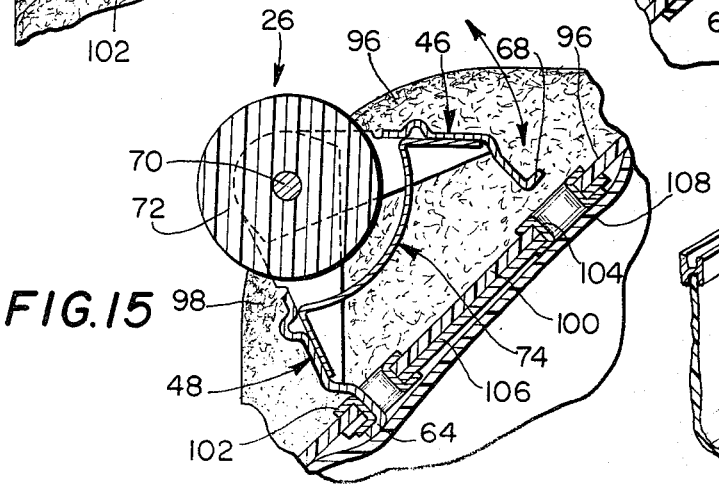
FIG. 15 is a sectional view similar to FIG. 14 and showing the roller assembly as it is inserted in the mounted position or removed therefrom.
Figure 16:
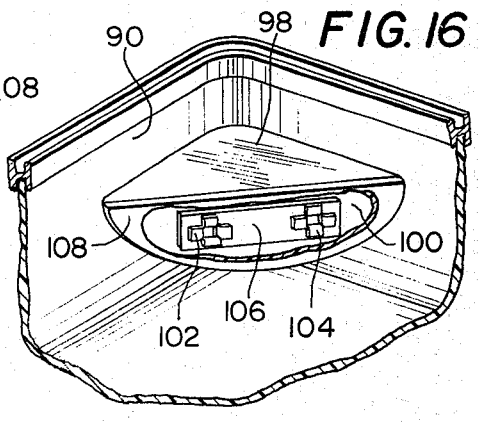
FIG. 16 is a fragmentary, perspective view of the interior of a corner of the modified form of the luggage case illustrating the manner in which the mounting plate of the roller assembly is secured in place.

Referring now to FIGS. 13, 14 and 15, the recess 96 as formed in the corner of the bottom section 88 defines shoulder 98 and 100 that are disposed at right angles with respect to each other. Formed in the shoulder 100 are spaced openings that receive grommets 102 and 104 therein. An interior mounting plate 106 that abuts the interior surface of the shoulder 100 is also formed with the openings that are aligned with the openings as formed in the shoulder 100, the grommets 102 and 104 extending through the openings in the mounting plate for securement therein as illustrated in FIGS. 14 and 15. The flanges of the grommets 102 and 104 are turned over the surfaces of the shoulder 100 and mounting plate 106 to firmly locate the grommets in place and to provide openings for receiving the tabs of a roller assembly 26 as will be described. An interior cover plate 108 is also secured to the interior surface of the shoulder 100 and is formed in a semi-circular configuration as illustrated in FIG. 16, the cover plate 108 having a construction that spaces it outwardly of the shoulder 100 to provide a space for receiving the shoulders of the grommets 102 and 104 and the tabs 64 and 68 of a roller assembly 26 as will be described.

The roller assemblies as utilized in the modified form of the invention are substantially the same as that described above in FIGS. 6, 7 and 8 and as noted are also indicated at 26. Thus, the roller assemblies 26 are mounted in place on the bottom and top sections 88 and 90, respectively, by inserting the tabs 64 and 68 of the mounting tabs 62 and 66 within the grommeted openings 102 and 104, the spring 74 urging the brackets 46 and 48 to the outer positions thereof for positively locking the roller assemblies in place. As shown in FIG. 13, the roller assembly 26 is located in the locked position thereof by inserting one of the tabs within a grommet opening and then inserting the other tab in the other grommet opening while the brackets 46 and 48 are in a depressed position relative to each other. When the brackets 46 and 48 are released, the spring 74 urges the brackets to the fully extended position for locking the roller assembly in the grommet openings in the recess 96. It is also seen that the use of the recessed corners 96 as formed in the top and bottom sections of the case substantially conceals the roller assemblies even after they have been mounted in place.

In the modified form of the luggage case 86 a special handle 110 is also provided that is grasped by the user 24 when the roller assemblies 26 are mounted in place. When the roller assemblies 26 are removed from the mounted position, plugs, such as plugs 84 shown in FIG. 10, may also be inserted into the grommets 102 and 104 for sealing the interior space as formed between the shoulder 100 and the mounting place 108.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A luggage case, comprising a pair of hinged sections, at least one of said sections including means for receiving a roller assembly thereon in detachable relation, spaced openings formed in said one section adjacent a corner thereof, said roller assembly including a pair of roller brackets through which a roller axle extends for pivotally mounting said roller brackets thereon, a mounting tab secured to each of said roller brackets at an outer end thereof, a roller rotatably mounted on said axle between said roller brackets, resilient means for normally urging the portions of said roller brackets on which said mounting tabs are mounted away from each other, said roller brackets being movable inwardly against the action of said resilient means for locating said tabs in said openings for releasably mounting said roller assembly on said one section, wherein said roller projects outwardly of said one section for engagement with a surface to provide for convenient travel of said luggage case thereon, said receiving means including a mounting plate that is secured interiorly of said one section, spaced openings formed in said mounting plate and being aligned with the openings in said one section, the tabs of said bracket assembly extending through the aligned openings in said one section and mounting plate for positively locking said roller assembly in place.

2. A luggage case as claimed in claim 1, grommets mounted in the aligned openings in said one section and said mounting plate for receiving said tabs therein when said roller assembly is mounted in position on said one section.

3. A luggage case as claimed in claim 1, a cover plate located interiorly of said one section and overlying said mounting plate in spaced relation with respect thereto, thereby concealing said openings from the case interior.

4. A luggage case, comprising a pair of hinged sections, at least one of said sections including means for receiving a roller assembly thereon in detachable relation, spaced openings formed in said one section adjacent a corner thereof, said roller assembly including a pair of roller brackets through which a roller axle extends for pivotally mounting said roller brackets thereon, a mounting tab secured to each of said roller brackets at an outer end thereof, a roller rotatably mounted on said axle between said roller brackets, resilient means for normally urging the portions of said roller brackets on which said mounting tabs are mounted away from each other, said roller brackets being movable inwardly against the action of said resilient means for locating said tabs in said openings for releasably mounting said roller assembly on said one section, wherein said roller projects outwardly of said one section for engagement with a surface to provide for convenient travel of said luggage case thereon, a corner of said one section having a portion cut out therefrom to define a pair of shoulders disposed at right angles to each other, said openings in said one section extending through one of said shoulders, wherein said roller assembly is located in said cut-out portion and said roller projects slightly therebeyond for contact with said surface.

5. A luggage case as claimed in claim 4, a corner of the other of said hinged sections having a portion cut-out therefrom opposite to said first named cut-out portion in the other hinged section and including a roller that projects therebeyond for contact with said surface, said rollers cooperating to balance said luggage case during the rolling movement thereof over said surface.

6. A luggage case as claimed in claim 4, a flat mounting plate secured to the interior of said shoulder through which said openings extend, openings formed in said mounting plate and being aligned with the openings in said one section, and grommets extending through said aligned openings for securing said mounting plate to said one section interiorly thereof.

7. A luggage case as claimed in claim 6, a cover plate secured to the shoulder in which said openings are formed interiorly thereof for concealing said mounting plate in the case interior.

8. A luggage case, comprising a pair of hinged sections, at least one of said sections including means for receiving a roller assembly thereon in detachable relation, spaced openings formed in said one section adjacent a corner thereof, said roller assembly including a pair of roller brackets through which a roller axle extends for pivotally mounting said roller brackets thereon, a mounting tab secured to each of said roller brackets at an outer end thereof, a roller rotatably mounted on said axle between said roller brackets, resilient means for normally urging the portions of said roller brackets on which said mounting tabs are mounted away from each other, said roller brackets being movable inwardly against the action of said resilient means for locating said tabs in said openings for releasably mounting said roller assembly on said one section, wherein said roller projects outwardly of said one section for engagement with a surface to provide for convenient travel of said luggage case thereon, said resilient means including a spring having a central portion that overlies said roller and arms that are joined to said central portion in angular relation with respect thereto, the arms of said spring being received in said roller brackets so as to normally urge said roller brackets outwardly, thereby locking said tabs in said openings upon insertion therein.

9. A luggage case as claimed in claim 8 each of said roller brackets having a recess formed therein in which said spring arms are received for positively locating said spring arms therein.

10. A luggage case as claimed in claim 9 said tabs as formed on the outermost ends of said brackets extending in opposite directions relative to each other, wherein said tabs are urged into a positive locking position in said openings by said spring upon insertion therein.

11. A luggage case, comprising a pair of hinged sections, at least one of said sections including means for receiving a roller assembly thereon in detachable relation, spaced openings formed in said one section adjacent a corner thereof, said roller assembly including a pair of roller brackets through which a roller axle extends for pivotally mounting said roller brackets thereon, a mounting tab secured to each of said roller brackets at an outer end thereof, a roller rotatably mounted on said axle between said roller brackets, resilient means for normally urging the portions of said roller brackets on which said mounting tabs are mounted away from each other, said roller brackets being movable inwardly against the action of said resilient means for locating said tabs in said openings for releasably mounting said roller assembly on said one section, wherein said roller projects outwardly of said one section for engagement with a surface to provide for convenient travel of said luggage case thereon, one of the openings in said one section being located in a first wall thereof located adjacent to said corner, and another of said openings being located in a second wall disposed at right angles to said first wall, and a mounting plate located interiorly of said one section and having openings formed therein, said mounting plate being bent so that the openings therein are aligned with the openings in said walls, and grommets extending through said aligned openings for receiving said tabs, thereby securing said mounting plate to said walls interiorly thereof.

12. A luggage case as claimed in claim 11, a cover plate secured to said walls interiorly thereof and spaced from said mounting plate for concealing said mounting plate in the case interior.

13. A luggage case as claimed in claim 12, plugs for insertion in said openings from the exterior of said one section for concealing said openings when said roller assembly is removed from the assembled position thereof.

14. A luggage case as claimed in claim 11, the opening as defined by one of said grommets being larger than the opening as defined by the other grommet, the smaller of said grommets being located on the leading wall of said case during the transport thereof over a surface.

15. A luggage case as claimed in claim 14, the size of the smaller of said grommets preventing direct insertion of a tab therein, so that the tab is tilted for insertion into the smaller grommet, the larger grommet being of a size to directly accommodate the other tab during the mounting of the roller assembly in place on said case section.

* * * * *